US005757143A

United States Patent [19]

Hernandez Martucci et al.

[11] Patent Number: 5,757,143

[45] Date of Patent: May 26, 1998

[54] DISCHARGE LAMP CONTROL CIRCUIT WITH FEEDBACK LOOP TO LOWER HARMONIC DISTORTION

[75] Inventors: Adan F. J. Hernandez Martucci, Eindhoven; Johannes H. Van Bijnen; Patrick J. Zijlstra, both of Oss, all of Netherlands

[73] Assignee: U.S. Philips Corporation, New York, N.Y.

[21] Appl. No.: 744,166

[22] Filed: Nov. 12, 1996

[30] Foreign Application Priority Data

Nov. 21, 1995 [EP] European Pat. Off. ..... 95203186

[51] Int. Cl.[6] ..... H05B 41/16

[52] U.S. Cl. ..... 315/247; 315/307; 315/244; 315/209 R; 315/DIG. 7

[58] Field of Search ..... 315/219, 227 R, 315/244, 291, 247, 209 R, 307, 308, DIG. 5, DIG. 7

[56] References Cited

U.S. PATENT DOCUMENTS

| | | | |
|---|---|---|---|
| 4,808,887 | 2/1989 | Fahnrich et al. | 315/247 |
| 4,949,013 | 8/1990 | Zuchtriegel | 315/106 |
| 5,008,597 | 4/1991 | Zuchtriegel | 315/209 R |
| 5,404,082 | 4/1995 | Hernandez et al. | 315/219 |
| 5,521,467 | 5/1996 | Statnic et al. | 315/247 |

FOREIGN PATENT DOCUMENTS

| | | |
|---|---|---|
| 0621743A1 | 10/1994 | European Pat. Off. . |
| 0679046A1 | 10/1995 | European Pat. Off. . |

*Primary Examiner*—Hubert Pascal
*Assistant Examiner*—Haissa Philogene
*Attorney, Agent, or Firm*—Edward Blocker

[57] ABSTRACT

A circuit arrangement for operating a discharge lamp with a high frequency current comprising input terminals for connection to a source of low frequency supply voltage, a rectifier bridge coupled to the input terminals for rectifying the low frequency supply voltage, and an inverter shunting a first capacitor for generating the high frequency current. The circuit arrangement incorporates two power feedback loops to feed power back to an output terminal of the rectifier bridge. As a result the circuit arrangement has a relatively simple configuration, causes only a very limited amount of harmonic distortion and can be realized with relatively cheap and simple components.

15 Claims, 3 Drawing Sheets

DISCHARGE LAMP CONTROL CIRCUIT WITH FEEDBACK LOOP TO LOWER HARMONIC DISTORTION

BACKGROUND OF THE INVENTION

This invention relates to a circuit arrangement for operating a discharge lamp with a high frequency current comprising input terminals for connection to a source of low frequency supply voltage, rectifier means coupled to said input terminals for rectifying said low frequency supply voltage, a first circuit comprising a series arrangement of first unidirectional means, second unidirectional means and first capacitive means coupled to a first output terminal N3 of said rectifier means and a second output terminal N5 of said rectifier means, inverter means shunting said first capacitive means for generating the high frequency current, a load circuit comprising a series arrangement of inductive means, second capacitive means and means for applying a voltage to the discharge lamp, said series arrangement connecting a terminal N1 of said inverter means to a terminal N2 between the first unidirectional means and the second unidirectional means, and a second circuit comprising third capacitive means for connecting terminal N2 to terminal N5.

Such a circuit arrangement is known from U.S. Pat. No. 5,404,082. The known circuit arrangement is very suitable to be powered from a regular mains supply generating, e.g. a supply voltage having an r.m.s. voltage of 230 Volt and a frequency of 50 Hz. The known circuit arrangement has a relatively high power factor that is realized with comparatively simple means. A drawback of the known circuit arrangement is, however, that the total harmonic distortion of the current that is drawn from the source of low frequency supply voltage increases strongly if the means for applying a voltage to the discharge lamp does not comprise a transformer and the lamp voltage is relatively high. In case, for instance, the supply voltage has an r.m.s. voltage of 230 Volt, the harmonic distortion increases strongly for a lamp voltage higher than approximately 70 Volt. It should be mentioned that a similar problem exists even for discharge lamps having much lower values of the lamp voltage in countries like, for instance the U.S.A. where the supply voltage has an r.m.s. voltage of only 120 Volt. This harmonic distortion can be decreased by incorporating a transformer in the means for applying a voltage to the discharge lamp. In case, however, the lamp voltage is relatively high and the means for applying a voltage to the discharge lamp comprises a transformer equipped with a primary winding and a secondary winding provided with terminals for the lamp connection, both the primary winding and other components comprised in the load circuit and the inverter have to conduct a relatively large current. This relatively large current can shorten the life of the circuit arrangement or make it necessary to dimension the circuit arrangement in accordance with this relatively large current, which is expensive. Another drawback of the known circuit arrangement is that it is often necessary to include a frequency modulator in the circuit arrangement to modulate the frequency of the high frequency current generated by the inverter means to correct for amplitude modulations in this high frequency current and to control the crest factor of the lamp current to a value less than approximately 1.7.

SUMMARY OF THE INVENTION

It is an object of the present invention to provide a circuit arrangement that causes relatively little harmonic distortion of the low frequency supply current, while the circuit arrangement is also capable of operating discharge lamps having a relatively high lamp voltage without the drawback that components in the load circuit and the inverter have to conduct a relatively large current during lamp operation.

A circuit arrangement according to the invention is for this purpose characterized in that the first output terminal N3 of the rectifier means is connected to a terminal N4 between the second unidirectional means and the first capacitive means by means of a third circuit comprising a series arrangement of third unidirectional means and fourth unidirectional means. A terminal N7 between said third unidirectional means and said fourth unidirectional means is connected to a terminal N6 that is part of the load circuit by means of a fourth circuit and neither the first circuit nor the third circuit comprises inductive means.

During operation of the circuit arrangement the fourth circuit couples power from terminal N6 to terminal N7. It has been found that this power feedback, that is realized with relatively simple means, causes a substantial decrease in harmonic distortion when compared with the harmonic distortion caused by the known circuit arrangement. Correspondingly, the power factor increases substantially with respect to the power factor of the known circuit arrangement. Surprisingly, despite the feedback realized by means of the fourth circuit, in a circuit arrangement according to the present invention the current conducted by components in the load circuit and the inverter is relatively small, even in the case where the means for applying a voltage to the discharge lamp comprises a transformer. For this reason it is not necessary to dimension the inverter and the load circuit for a relatively large current and the load circuit and the inverter circuit can therefore be realized with relatively cheap components. Furthermore, it has been found that it is possible to dispense with a transformer in the load circuit of a circuit arrangement according to the invention and keep the harmonic distortion at a relatively low level at the same time, even in case the lamp voltage of the discharge lamp operated with the circuit arrangement is relatively high. In case the load circuit does not comprise a transformer, the amplitude of the current that flows through components of the inverter means and the load circuit during operation is further decreased with respect to circuit arrangements according to the invention comprising a transformer in the load circuit. Another important advantage of a circuit arrangement according to the invention is that a frequency modulator for modulating the frequency of the high frequency current can also be dispensed with, since it was found that the amplitude of the high frequency current generated by a circuit arrangement according to the invention is not strongly modulated and therefore the crest factor of the lamp current is relatively low. Both the modulator and more particularly the transformer are relatively expensive components so that the possibility to dispense with both in a circuit arrangement according to the invention is another reason why the circuit arrangement according to the invention has a relatively simple configuration and is therefore relatively inexpensive.

It also should be mentioned that a circuit arrangement comprising a double power feedback similar to the double power feedback in a circuit arrangement according to the present invention has been disclosed in EP 679046-A1. In the circuit arrangement disclosed in EP 679046-A1, the improvement of the power factor is mainly effected by making use of a storage coil. Such a storage coil is a rather expensive component. In a circuit arrangement according to the present invention a high power factor is achieved without making use of a storage coil. For this reason the functioning of a circuit arrangement according to the present invention differs from that disclosed in EP 679046-A1. Furthermore, a circuit arrangement according to the present invention offers a substantial advantage over the disclosure of EP 679046-A1 because in a circuit arrangement according to the invention the expensive storage coil can be dispensed with.

It has been found that a smooth operation of the circuit arrangement could be realized in the case where the second circuit further comprises the first capacitive means.

A smooth operation of the circuit arrangement was also found for configurations of the circuit arrangement wherein the fourth circuit comprises fourth capacitive means.

The unidirectional means preferably comprise diode means. The unidirectional means are thus realized in a very simple way.

In a preferred embodiment of a circuit arrangement according to the invention the inverter means comprise a series arrangement of a first switching element, terminal N1 and a second switching element, and a drive circuit DC coupled to the switching elements for generating a drive signal for rendering the switching elements alternately conducting and non-conducting. The inverter is thus realized in a relatively simple and dependable way.

It has been found that the circuit arrangement according to the invention is very suitable for operating two discharge lamps in parallel. In a preferred embodiment of a circuit arrangement according to the invention for operating two discharge lamps, the load circuit comprises a further series arrangement of inductive means, capacitive means and means for applying a voltage to a discharge lamp, and a terminal N8 that is part of the further series arrangement is connected to terminal N7 by means of a fifth circuit the fifth circuit preferably comprises fifth capacitive means.

In a further preferred embodiment of a circuit arrangement according to the invention terminal N4 is connected to terminal N7 by a circuit comprising a switching element S and a control circuit coupled to a control electrode of switching element S for rendering switching element S conductive and non-conductive. The control circuit renders the switching element S conductive when the lamp current is zero, for instance during preheating of the lamp electrodes or during ignition of the discharge lamp. An overvoltage across the first capacitive means is thereby prevented. After the discharge lamp has ignited the control circuit renders the switching element S non-conductive. The control circuit could for instance comprise means for detecting a lamp current. It has been found, however, that a very simple and dependable way to construct the control circuit is to equip said control circuit with means for rendering the switching element S conductive and non-conductive dependent upon the voltage across said first capacitive means.

BRIEF DESCRIPTION OF THE DRAWING

Embodiments of the invention will be explained in more detail with reference to the accompanying drawing, in which.

DESCRIPTION OF THE PREFERRED EMBODIMENTS

Figure 1:
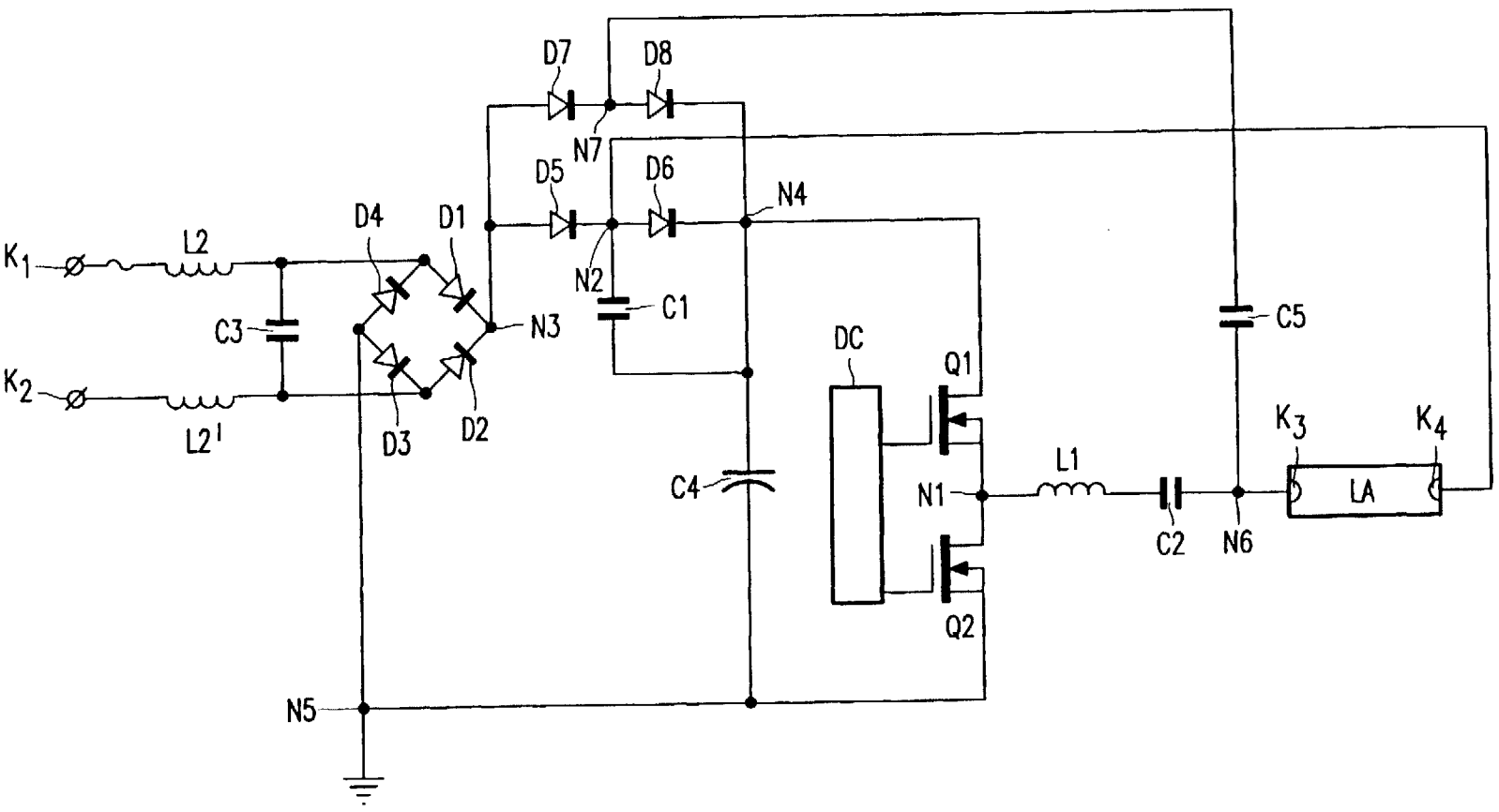
FIG. 1 is a simplified schematic diagram of a first embodiment of a circuit arrangement according to the present invention with a discharge lamp LA connected to the circuit arrangement.

In FIG. 1 K1 and K2 are input terminals for connection to a source of low frequency supply voltage. L2 and L2' are inductors that form an input filter together with capacitor C3. Diodes D1–D4 are rectifier means for rectifying said low frequency supply voltage. In this embodiment diodes D5 and D6 form first and second unidirectional means, respectively. Capacitor C4 is first capacitive means and forms together with diodes D5 and D6 a first circuit. Switching elements Q1 and Q2 together with a drive circuit DC form inverter means. Drive circuit DC is a circuit part for generating drive signals for rendering switching elements Q1 and Q2 conducting and non-conducting. Inductor L1, capacitor C2 and terminals K3 and K4 for connecting to a discharge lamp together form a load circuit. In the embodiment shown in FIG. 1 inductor L1 forms inductive means, capacitor C2 forms second capacitive means and terminals K3 and K4 for connecting to a discharge lamp form the means for applying a voltage to the discharge lamp. Capacitor C1 forms a third capacitive means. Capacitor C1 and capacitor C4 together form a second circuit. Diodes D7 and D8 form third and fourth unidirectional means, respectively. The series arrangement of diodes D7 and D8 forms a third circuit. Capacitor C5 forms fourth capacitive means and also a fourth circuit.

Input terminals K1 and K2 are connected by means of a series arrangement of inductor L2, capacitor C3 and inductor L2' respectively. A first side of capacitor C3 is connected to a first input terminal of the rectifier bridge and a second side of capacitor C3 is connected to a second input terminal of the rectifier bridge. A first output terminal N3 of the rectifier bridge is connected to a second output terminal N5 of the rectifier bridge by means of a series arrangement of diode D5, diode D6 and capacitor C4. N2 is a common terminal of diode D5 and diode D6. N4 is a common terminal of diode D6 and capacitor C4. Terminal N2 is connected to terminal N4 by means of capacitor C1. The series arrangement of diodes D5 and D6 is shunted by a series arrangement of diodes D7 and D8. N7 is a common terminal of diodes D7 and D8. Capacitor C4 is shunted by a series arrangement of switching elements Q1 and Q2. A control electrode of switching element Q1 is connected to a first output terminal of drive circuit DC. A control electrode of switching element Q2 is connected to a second output terminal of drive circuit DC. N1 is a common terminal of switching element Q1 and switching element Q2. Terminal N1 is connected to terminal N2 by means of a series arrangement of respectively inductor L1, capacitor C2, terminal K3, discharge lamp LA and terminal K4. N6 is a common terminal of capacitor C2 and terminal K3. Terminal N6 is connected to terminal N7 by means of capacitor C5.

The operation of the circuit arrangement shown in FIG. 1 is as follows.

When input terminals K1 and K2 are connected to the poles of a source of a low frequency supply voltage, the rectifier bridge rectifies the low frequency supply voltage supplied by this source so that a DC-voltage is present over capacitor C4 serving as a buffer capacitor. Drive circuit DC renders the switching elements Q1 and Q2 alternately conducting and non-conducting and as a result a substantially square wave voltage having an amplitude approximately equal to the amplitude of the DC-voltage on capacitor C4 is present at terminal N1. The substantially square wave voltage present at terminal N1 causes an alternating current to flow through inductor L1 and capacitor C2. A first part of this alternating current flows through terminals K3 and K4, the discharge lamp LA and terminal N2. The remaining part of this alternating current flows through capacitor C5 and terminal N7. As a result both at terminal N2 as well as at terminal N7 voltages having the same frequency as the substantially square wave voltage are present. These voltages present at terminal N2 and terminal N7 cause a pulsatory current to be drawn from the supply voltage source, also when the voltage on capacitor C4 is higher than the momentary amplitude of the rectified low frequency supply voltage. For this reason the power factor of the circuit arrangement has a relatively high value and the total harmonic distortion of the supply current is relatively low.

It should be mentioned that similar results were obtained for a configuration of the circuit arrangement slightly differing from the configuration shown in FIG. 1, where capacitor C1 connects terminal N2 to terminal N5 instead of to terminal N4. In this slightly different configuration capacitor C1 forms third capacitive means and a second circuit.

In a practical realization of an embodiment as shown in FIG. 1, the dimensioning was as follows: L1=905 μH, C5=5.6 nF, C1=18 nF, C4=11 μF, C3=220 nF and C2=180 nF, L2=1 mH and L2'=1 mH. With this embodiment a low pressure mercury discharge lamp with a nominal power of 58 Watt was operated. The lamp voltage of this lamp was 110 Volt. The frequency of the substantially square wave voltage was approximately 50 kHz and the power consumed from the low frequency supply voltage source was 52.3 Watt. The low frequency supply voltage source was a European mains supply supplying 230 Volts r.m.s with a frequency of 50 Hz. The lamp current was 452 mA r.m.s. The lamp current crest factor was 1.43. The current through the switching elements was 591 mA rms. The total harmonic distortion was less than 10%. It was found that when the same low pressure mercury discharge lamp was operated by means of a known circuit arrangement as described in U.S. Pat. No. 5,404,082 and equipped with a substantially identical input filter, a transformer was needed in the load circuit to keep the total harmonic distortion level at less than 10%. When the r.m.s value of the current through the low pressure mercury discharge lamp operated by means of the known circuit arrangement was approximately equal to 452 mA, the current through the switching elements was approximately 798 mA r.m.s. The r.m.s value of the current through the switching elements is thus 35% higher than when a circuit arrangement according to the invention is used.

Figure 2:
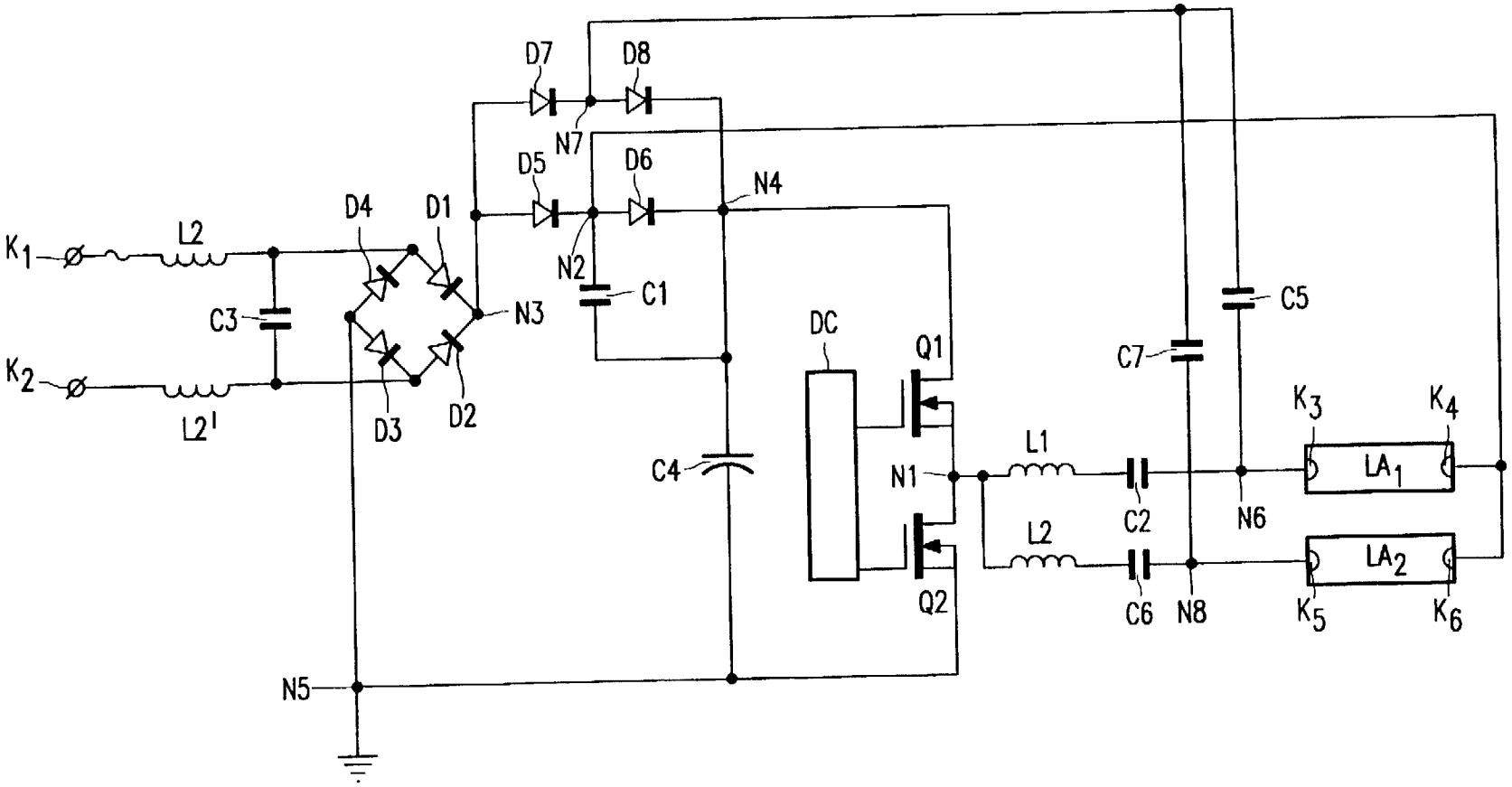
FIG. 2 is a simplified schematic diagram of a second embodiment of a circuit arrangement according to the invention with two discharge lamps LA1 and LA2 connected to the circuit arrangement.

The embodiment shown in FIG. 2 is to a large extent similar to the embodiment shown in FIG. 1. Similar components and circuit parts are indicated with the same reference signs in both figures. The load circuit of the embodiment of FIG. 2 comprises a further series arrangement of inductive means capacitive means, and means for applying a voltage to a discharge lamp, formed respectively by inductor L3, capacitor C6 and terminal K5 and terminal K6. A discharge lamp LA2 is connected to terminals K5 and K6. For clarity the discharge lamp connected to terminals K3 and K4 is indicated by LA1 in FIG. 2. Terminal K6 is connected to terminal K4. A terminal N8 between capacitor C6 and terminal K5 is connected to a first side of capacitor C7. A further side of capacitor C7 is connected to N7. Capacitor C7 forms in this embodiment both a fifth circuit and fifth capacitive means.

The operation of the embodiment shown in FIG. 2 is similar to that of the embodiment shown in FIG. 1 and will not be described separately.

Figure 3:
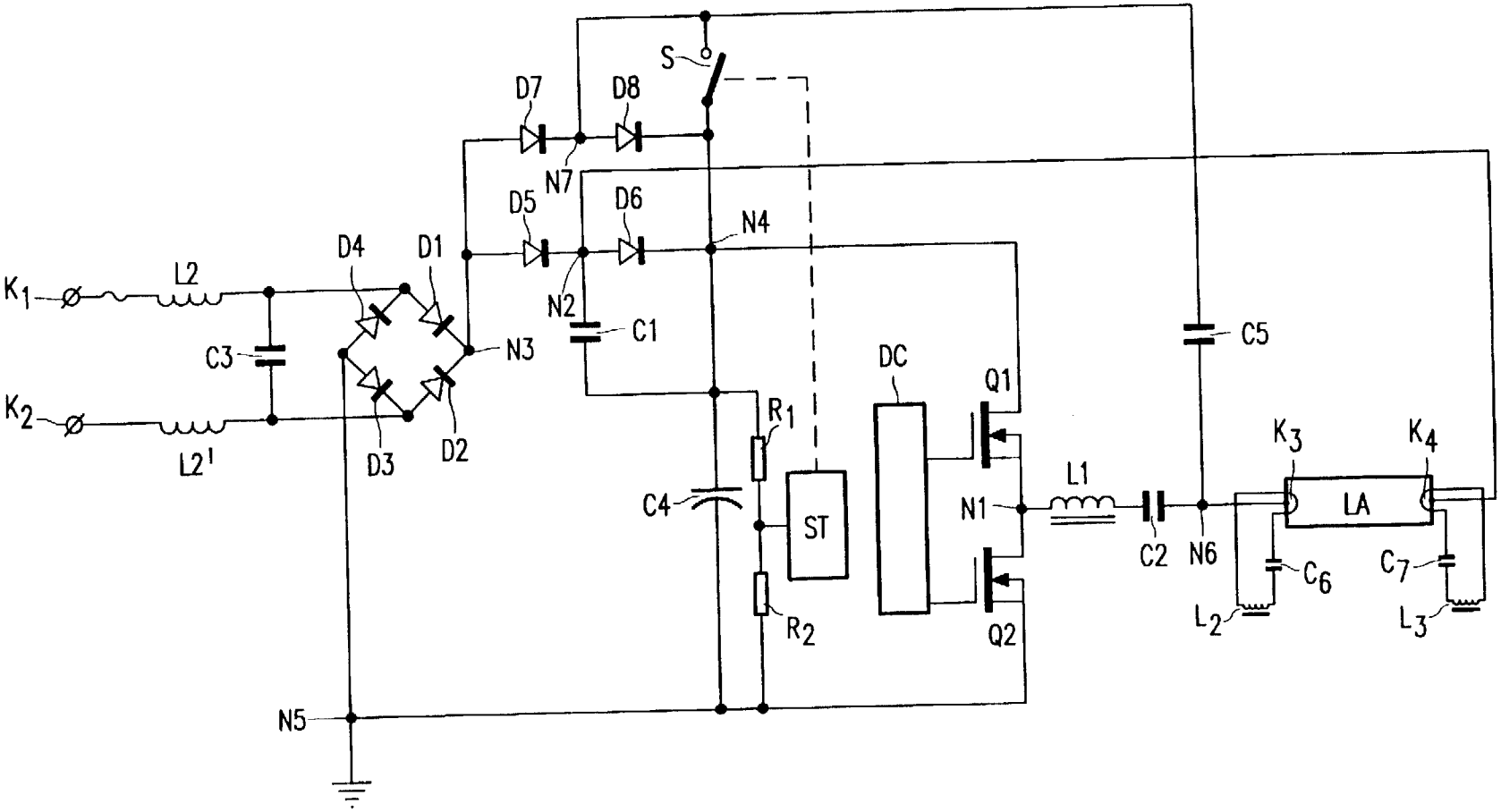
FIG. 3 is a simplified schematic diagram of a third embodiment of a circuit arrangement according to the present invention with a discharge lamp LA connected to the circuit arrangement.

The embodiment shown in FIG. 3 differs from the embodiment shown in FIG. 1 in that a switching element S connects terminal N4 to terminal N7. A control electrode of switching element S is coupled to an output terminal of circuitpart ST. In FIG. 3 this is indicated by means of a dotted line. Capacitor C4 is shunted by a series arrangement of resistor R1 and resistor R2. A common terminal of resistor R1 and resistor R2 is connected to an input terminal of circuitpart ST. The embodiment shown in FIG. 3 is also equipped with a means for preheating the electrodes of the discharge lamp La before ignition. These means comprise secondary windings L2 and L3 of coil L1 and capacitors C6 and C7. Each of the lamp electrodes is shunted by a series arrangement of a secondary winding and one of the capacitors C6 and C7.

The operation of the embodiment shown in FIG. 3 is as follows. Before the discharge lamp La has ignited, the lamp electrodes are preheated during a predetermined time lapse by rendering the switching elements conductive and non-conductive at a frequency at which the impedance of capacitors C6 and C7 is relatively low. Both during this preheating as well as during the ignition phase, the amplitude of the voltage across capacitor C4 increases to a value that is higher than the value during stationary operation of the discharge lamp. This higher amplitude is caused by the fact that the lamp current is zero while power is fed back via capacitor C5. The voltage at the input terminal of circuit part ST is proportional to the voltage on capacitor C4. When the voltage over capacitor C4 reaches a first predetermined value the circuit part ST renders switching element S conductive so that diode D8 is shortcircuited, whereby a further increase of the voltage across capacitor C4 is prevented. When after the ignition of the discharge lamp the amplitude of the voltage on capacitor C4 drops below a second predetermined value (lower than the first predetermined value) the circuitpart ST renders switching element S non-conductive so that power feedback via capacitor C5 is activated. The operation of the embodiment shown in FIG. 3 during stationary operation is identical to that of the embodiment shown in FIG. 1 and will not be further described.

We claim:

1. A circuit arrangement for operating a discharge lamp with a high frequency current, comprising:

input terminals for connection to a source of low frequency supply voltage, rectifier means coupled to said input terminals for rectifying said low frequency supply voltage, a first circuit comprising a series arrangement of first unidirectional means, second unidirectional means and first capacitive means coupled to a first output terminal of said rectifier means and to a second output terminal of said rectifier means, inverter means shunting said first capacitive means for generating the high frequency current, a load circuit comprising a series arrangement of inductive means, second capacitive means and means for applying a voltage to the discharge lamp, said load circuit connecting a terminal of said inverter means to a first terminal between the first unidirectional means and the second unidirectional means, and a second circuit comprising third capacitive means for connecting the first terminal to the second output terminal, and wherein the first output terminal of the rectifier means is connected to a second terminal between the second unidirectional means and the first capacitive means by means of a third circuit comprising a series arrangement of third unidirectional means and fourth unidirectional means, and a third terminal between said third unidirectional means and said fourth unidirectional means is connected to a terminal that is part of the load circuit by means of a fourth circuit, and in that neither the first circuit nor the third circuit comprises inductive means.

2. The circuit arrangement as claimed in claim 1 wherein the first and third circuits are connected to the first output terminal of the rectifier means via a non-inductive connection means.

3. The circuit arrangement according to claim 1, wherein the fourth circuit comprises fourth capacitive means.

4. The circuit arrangement according to claim 1, wherein the unidirectional means comprise diode means.

5. The circuit arrangement according to claim 1, wherein said inverter means comprise a series arrangement of a first switching element a fourth terminal and a second switching element, and a drive circuit DC coupled to the switching elements for generating a drive signal for rendering the switching elements alternately conducting and non-conducting.

6. The circuit arrangement according to claim 1, wherein the load circuit comprises a further series arrangement of inductive means, capacitive means and means for applying a voltage to a discharge lamp, and a fifth terminal that is part of the further series arrangement is connected to the third terminal by means of a fifth circuit.

7. The circuit arrangement according to claim 6, wherein the fifth circuit comprises fifth capacitive means.

8. The circuit arrangement according to claim 1, wherein the second terminal is connected to the third terminal by a circuit comprising a switching element, and further comprising a control circuit coupled to a control electrode of the switching element for rendering the switching element conductive and non-conductive.

9. The circuit arrangement according to claim 8, wherein said control circuit comprises means for rendering the switching element conductive and non-conductive dependent upon of the voltage on said first capacitive means.

10. The circuit arrangement as claimed in claim 8 wherein the control circuit makes the switching element conduct during ignition of the discharge lamp and cuts it off during normal operation of the discharge lamp.

11. The circuit arrangement as claimed in claim 3 wherein the series arrangement of the inductive means and the second capacitive means is connected in series circuit with the fourth capacitive means between the inverter means and the third terminal.

12. The circuit arrangement as claimed in claim 1 wherein said inverter means supplies high frequency AC energy to the load circuit and to the third terminal via the fourth circuit.

13. The circuit arrangement as claimed in claim 1 wherein the second circuit further comprises the first capacitive means in series circuit with the third capacitive means.

14. A circuit arrangement for operating a discharge lamp with a high frequency current, comprising:

input terminals for connection to a source of low frequency supply voltage, rectifier means coupled to said input terminals for rectifying said low frequency supply voltage, a first circuit comprising a series arrangement of first unidirectional means, second unidirectional means and first capacitive means coupled to a first output terminal of said rectifier means and to a second output terminal of said rectifier means, inverter means shunting said first capacitive means for generating the high frequency current, a load circuit comprising a series arrangement of inductive means, second capacitive means and means for applying a voltage to the discharge lamp, said load circuit connecting a terminal of said inverter means to a first terminal between the first unidirectional means and the second unidirectional means, a second circuit comprising third capacitive means and said first capacitive means for connecting the first terminal to the second output terminal, and wherein the first output terminal of the rectifier means is connected to a second terminal between the second unidirectional means and the first capacitive means by means of a third circuit comprising a series arrangement of third unidirectional means and fourth unidirectional means, and a third terminal between said third unidirectional means and said fourth unidirectional means is connected to a terminal that is part of the load circuit by means of a fourth circuit.

15. The circuit arrangement as claimed in claim 14 wherein said inverter means comprise first and second switching transistors connected in series circuit and the first and third circuits are devoid of inductive means.

* * * * *